US005176976A

United States Patent [19]

Kikuchi et al.

[11] Patent Number: 5,176,976

[45] Date of Patent: Jan. 5, 1993

[54] ORGANIC ELECTRONIC MATERIAL AND ELECTROPHOTOGRAPHIC PHOTOSENSITIVE MEMBER CONTAINING SAME

[75] Inventors: Toshihiro Kikuchi, Yokohama; Akio Maruyama, Kawasaki, both of Japan

[73] Assignee: Canon Kabushiki Kaisha, Tokyo, Japan

[21] Appl. No.: 680,824

[22] Filed: Apr. 5, 1991

[30] Foreign Application Priority Data

Apr. 9, 1990 [JP] Japan ..... 2-92183

[51] Int. Cl.[5] ..... G03G 5/047; G03G 5/09

[52] U.S. Cl. ..... 430/58; 430/70; 430/83; 355/211; 358/300; 552/304

[58] Field of Search ..... 430/58, 70, 83

[56] References Cited

U.S. PATENT DOCUMENTS

| | | | |
|---|---|---|---|
| 3,615,565 | 10/1971 | Gerrach et al. | 430/495 X |
| 3,975,285 | 8/1976 | Ohnishi et al. | 252/299 |
| 4,222,902 | 9/1980 | Hoffman et al. | 252/299 |
| 4,728,592 | 3/1988 | Ohaku et al. | 430/59 |

FOREIGN PATENT DOCUMENTS

| | | | |
|---|---|---|---|
| 52-04188 | 2/1977 | Japan . | |
| 54-58445 | 5/1979 | Japan . | |
| 54-151955 | 11/1979 | Japan . | |
| 55-52063 | 4/1980 | Japan . | |
| 55-42380 | 10/1980 | Japan . | |
| 58-19804 | 2/1983 | Japan . | |
| 58-32372 | 7/1983 | Japan . | |
| 61-75355 | 4/1986 | Japan . | |
| 61-132955 | 6/1986 | Japan . | |
| 61-148159 | 7/1986 | Japan . | |
| 63-70257 | 3/1988 | Japan . | |
| 63-72664 | 4/1988 | Japan . | |
| 63-85749 | 4/1988 | Japan . | |
| 63-104061 | 5/1988 | Japan . | |
| 63-174993 | 7/1988 | Japan . | |
| 63-175860 | 7/1988 | Japan . | |
| 206349 | 8/1989 | Japan | 430/70 |
| 1183044 | 3/1970 | United Kingdom . | |

*Primary Examiner*—Roland Martin

*Attorney, Agent, or Firm*—Fitzpatrick, Cella, Harper & Scinto

[57] ABSTRACT

An organic electronic material comprises a compound represented by the following formula (I).

The compounds transport electrons and is excellent in durability when used in a photosensitive layer of an electrophotographic photosensitive member.

10 Claims, 1 Drawing Sheet

ORGANIC ELECTRONIC MATERIAL AND ELECTROPHOTOGRAPHIC PHOTOSENSITIVE MEMBER CONTAINING SAME

BACKGROUND OF THE INVENTION

1. Field of the Invent

The present invention relates to an organic electronic material, and an electrophotographic photosensitive member having superior electrophotographic performances attributable to the employment of the material.

2. Related Background Art

In recent years, function-separated electrophotographic photosensitive members, in which the function of generating charges and the function of transporting charges are shared by respectively separate electronic materials, have brought about a marked improvement in the sensitivity and durability properties for which conventional organic photosensitive members have been considered to have disadvantages.

Such function-separated electrophotographic photosensitive members allow a wide range of selection of materials for charge-generating materials an charge-transporting materials, and hence can also be advantageous in, e.g., that electrophotographic photosensitive members having the desired performance can be produced with a greater ease and at a low cost.

As the charge-generating materials, various materials are known, including azo pigments, polycyclic quinone pigments, cyanine dyes, squaric acid dyes and pyrylium salt dyes.

Of these, azo pigments have the advantages that they have a high light-fastness, have a high charge-generating ability and can be synthesized with ease. Hence, many materials have been proposed.

As for the charge-transporting materials, known materials are exemplified by the pyrazolone compounds as disclosed in Japanese Patent Publication No. 52-4188, the hydrazone compounds as disclosed in Japanese Patent publication No. 55-42380 and Japanese Patent Application Laid-open No. 55-52063, the triphenylamine compounds as disclosed in Japanese Patent Publication No. 58-32372 and Japanese Patent Application Laid-open No. 61-132955, and the stilbene compounds as disclosed in Japanese Patent Applications Laid-open No. 54-151955 and No. 58-19804.

However, almost all of the known charge-transporting materials noted in the above, in particular, the charge-transporting materials used in organic electrophotographic photosensitive members practically used, have the properties of transporting positive holes.

When a charge-transporting material capable of transporting positive holes is used in an electrophotographic photosensitive member comprising a conductive support and, provided thereon, a charge generation layer and a charge transport layer in this order, i.e. having the conventional structure most commonly used, the polarity of the primary charge to the photosensitive member is negative. When the photosensitive member is negatively charged, ozone is generated. This ozone has a bad chemical bad influence on photosensitive members.

Now, as a countermeasure to the deterioration of photosensitive members due to the ozone generated in negative charging, a proposal has been made in, for example, Japanese Patent Applications Laid-open No. 61-753555 and No. 54-58445 on an electrophotographic photosensitive member comprising a support and, provided thereon, a charge transport layer and a charge generation layer in this order.

Since, however, in the electrophotographic photosensitive member with such layer constitution, the relatively thin charge generation layer is provided as an upper layer, a serious deterioration of performance is caused by the wear that accompanies repeated use.

When a photosensitive member is provided with a protective layer made of an organic insulating material for the purpose of preventing such wear, it has been impossible to maintain stable performances because of unstable potential after repeated use.

Under such circumstances, it has been sought to develop an organic electronic material capable of transporting electrons. Conventionally proposed charge-transporting materials capable of transporting electrons include, for example, 2,4,7-trinitro-9-fluorenone (TNF), the dicyanomethylenefluorene carboxylates as disclosed in Japanese Patent Application Laid-open No. 61-148159, the anthraquinodimethane compounds as disclosed in Japanese Patent Applications Laid-open No. 63-70257, No. 63-72664 and No. 63-104061, the 1,4-naphthoquinone compounds as disclosed in Japanese Patent Application Laid-open No. 63-85749, the diphenyldicyanoethylene compounds as disclosed in Japanese Patent Applications Laid-open No. 63-175860 and No. 63-174993, and the diphenoquinone compounds as described in The Proceedings of the 58th Springtime Annual Meeting of Japan Chemical Society (31H38), 431 (1989).

However, positive-charge photosensitive members making use of these charge-transporting materials capable of transporting electrons have been unsatisfactory in view of their residual potential after repeated use, their production cost and the compatibility with organic solvents and binders.

SUMMARY OF THE INVENTION

An object of the present invention is to provide an Organic electronic material containing a compound capable of transporting electrons, and an electrophotographic photosensitive member having a photosensitive layer containing such a compound.

Another object of the present invention is to provide an organic electronic material containing a compound capable of giving stable and, good electrophotographic properties even after repeated use, and an electrophotographic photosensitive member having a photosensitive layer containing such a compound.

The present invention provides an organic electronic material comprising a compound represented by the following formula (I).

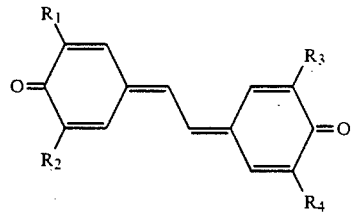

Formula (I)

wherein R1, R2, R3 and R4 each represents a hydrogen atom, an alkyl group, an aralkyl group or an aryl group, and $R_1$, $R_2$, $R_3$ and $R_4$may be the same or different.

The present invention also provides an electrophotographic photosensitive member comprising a conductive support and a photosensitive layer provided on the conductive support; the photosensitive layer contains a compound represented by the following formula (I).

Formula (I)

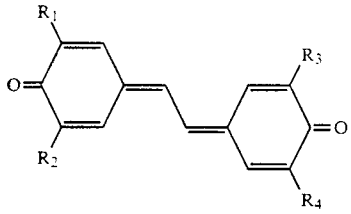

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different one another.

DESCRIPTION OF THE PREFERRED EMBODIMENTS

Figure 1:
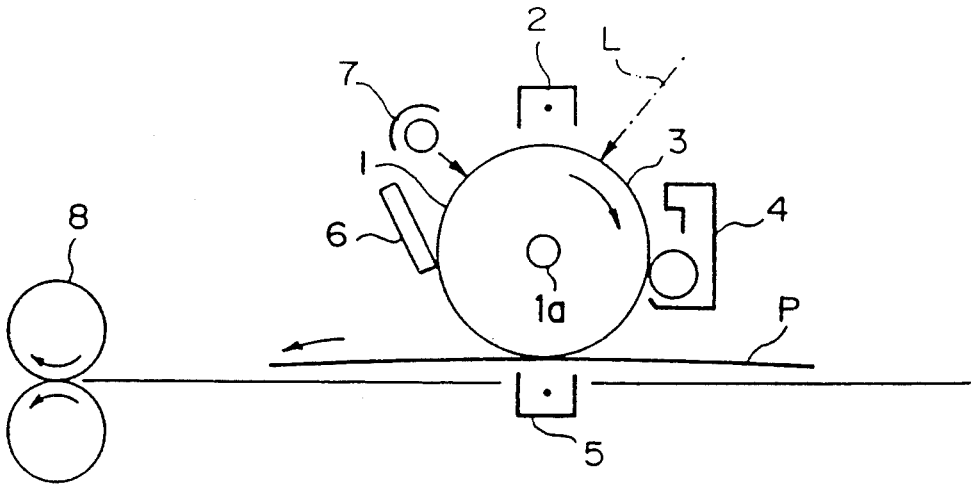
FIG. 1 schematically illustrates an example of the constitution of an electrophotographic apparatus in which the electrophotographic photosensitive member of the present invention is used.

The present invention is an organic electronic material containing a compound represented by the following formula (I), and an electrophotographic photosensitive member having a photosensitive layer containing such a compound.

Formula (I)

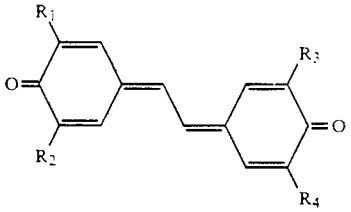

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different.

In the formula (I), the alkyl group may include groups such as methyl, ethyl, n-propyl, n-butyl and t-butyl. The aralkyl group may include groups such as benzyl and phenethyl. The aryl group may include groups such as phenyl and naphthyl.

Typical examples of the stilbenequinone compounds represented by the formula (1) are shown below. The compounds are by no means limited to these.

The examples of the compound are set forth by showing the substituents $R_1$, $R_2$, $R_3$ and $R_4$ variable in the following base structure.

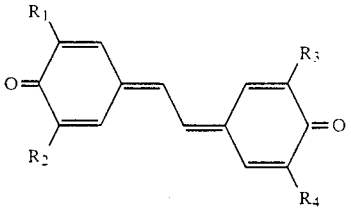

Exemplary Compound (1)
$R_1$, $R_2$, $R_3$, $R_4$: $-CH_3$
Exemplary Compound (2)
$R_1$, $R_2$, $R_3$, $R_4$: $-H$
Exemplary Compound (3)
$R_1$, $R_2$, $R_3$, $R_4$: $-C_2H_5$
Exemplary Compound (4)
$R_1$, $R_2$, $R_3$, $R_4$: -t-$C_4H_9$
Exemplary Compound (5)
$R_1$, $R_2$: $-CH_3$
$R_3$, $R_4$: -t-$C_4H_9$
Exemplary Compound (6)
$R_1$, $R_2$: $-C_2H_5$
$R_3$, $R_4$: -n-$C_4H_9$
Exemplary Compound (7)
$R_1$, $R_2$: H
$R_3$, $R_4$: -n-$C_4H_9$
Exemplary Compound (8)
$R_1$: $-CH_3$, $R_2$: $-C_2H_5$
$R_3$: $-CH_3$, $R_4$: $-C_2H_5$
Exemplary Compound (9)
$R_1$: $-CH_3$, $R_2$: $-C_2H_5$
$R_3$: $-C_2H_5$, $R_4$: $-CH_3$
Exemplary Compound (10)
$R_1$, $R_2$: $-CH_3$ $R_3$, $R_4$: $-CH_2-$ 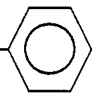

Exemplary Compound (11)
$R_1$, $R_2$: -n-$C_3H_7$
$R_3$, $R_4$: -t-$C_4H_9$
Exemplary Compound (12)

$R_1$, $R_2$, $R_3$, $R_4$: $-CH_2-$ 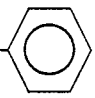

Exemplary Compound (13)

$R_1$: 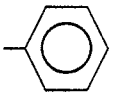 $R_2$: $-CH_3$ $R_3$: 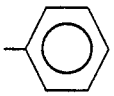 $R_4$: $-CH_3$

Exemplary Compound (14)

$R_1$: 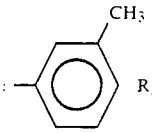

$R_2$: $-H$

-continued

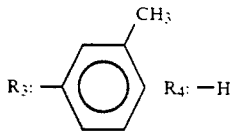

Exemplary Compound (15)
$R_1$, $R_2$: -n-$C_3H_7$

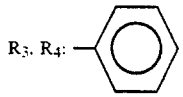

Exemplary Compound (16)

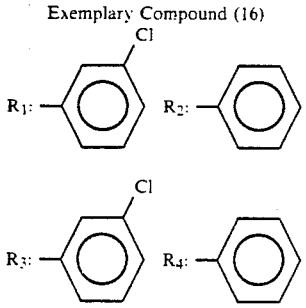

The organic electronic material of the present invention can be used in, for example, the photosensitive layer of the electrophotographic photosensitive member.

The electrophotographic photosensitive member can be constituted in any of the following forms:

(1) On a conductive support, a layer containing a charge-generating material and a layer containing a charge-transporting material are successively laminated.

(2) On a conductive support, a layer containing a charge-transporting material and a layer containing a charge-generating material are successively laminated.

(3) On a conductive support, a layer containing a charge-generating material and a charge-transporting material is formed.

(4) On a conductive support, a layer containing a charge-transporting material and a layer containing a charge-generating material and a charge-transporting material are successively laminated.

(5) On a conductive support, a layer containing a charge-generating material and a layer containing a charge-generating material and a charge-transporting material are successively laminated.

The stilbenequinone compound represented by the formula (I) of the present invention is so highly capable of transporting electrons that it can be used as the charge-transporting material in the photosensitive layer of the electrophotographic photosensitive member of any of the above forms. In the case when the electrophotographic photosensitive member is of form (1), it can be preferably used in positive charging, and in the case of form (2), in negative charging. In the oases of forms (3), (4) and (5), the photosensitive members can be used in any of positive charging and negative charging.

In the present invention, the form (1) is particularly preferred among the above embodiments. However, the embodiments the electrophotographic photosensitive member in the present invention are by no means limited to the above.

The constitution of the present invention will be further detailed below.

The charge-generating material used in the present invention may be any of those capable of generating charges as charge-generating materials. It may include, for example, the following:

(1) Azo pigments such as monoazo, bisazo and trisazo pigments.

(2) Phthalocyanine pigments such as metal phthalocyanine and metal-free phthalocyanine.

(3) Indigo pigments such as indigo and thioindigo.

(4) Perylene pigments such as perylene anhydrides and perylene imides.

(5) Polycyclic quinone pigments such as anthraquinone and pyrenequinone.

(6) Squarilium dyes.

(7) Pyrylium salts and thiopyrylium salts.

(8) Triphenylmethane dyes.

(9) Inorganic materials such as selenium and amorphous silicon.

These charge-generating material may be used alone or in combination of two or more kinds.

The layer that contains the charge-generating material, i.e., the charge generation layer can be formed by dispersing the charge-generating material as described above in a suitable binder and by coating a conductive support with the dispersion. It can also be formed by forming a thin film or by a dry process such as sputtering or CVD.

The binder can be selected from a vast range of binder resins including, for example, polycarbonate, polyester, polyacrylate, butyral resins, polystyrene, polyvinyl acetal, diallylphthalate resins, acrylic resins, methacrylic resins, vinyl acetate resins, phenol resins, silicone resins, polysulfone, a styrene-butadiene copolymer, alkyd resins, epoxy resins, urea resins and a vinyl chloride-vinyl acetate copolymer. The binder is by no means limited to these.

These resins may be used alone, in the form of a copolymer of any of these components or in the form of a mixture of two or more kinds of resins.

The resin amount contained in the charge generation layer is preferably in an amount of not more than 80% by weight, and particularly preferably not more than 40% by weight, based on the total weight of the layer.

The charge generation layer may preferably have a layer thickness of not more than 5 μm, and particularly from 0.01 μm to 2 μm.

Various sensitizers may be further added to the charge generation layer.

The layer that contains the charge-transporting material, i.e., the charge transport layer can be formed by combination of the stilbenequinone compound represented by the formula (I) with a suitable binder resin.

In the present invention, a charge-transporting material of a different type can also be used in combination.

The binder resin used may include, in addition to those used in the charge generation layer, photoconductive polymers such as polyvinyl carbazole and polyvinyl anthracene.

As to the mixing proportion of this binder resin to the stilbenequinone compound represented by the formula (I), the stilbenequinone compound may preferably be in an amount of from 10 parts by weight to 500 parts by weight based on 100 parts by weight of the binder.

The charge transport layer may preferably have a layer-thickness of from 5 μm to 40 μm, and particularly from 10 μm to 30 μm.

It is also possible to optionally further add in the charge transport layer an antioxidant, an ultraviolet absorbent, a plasticizer or a conventionally known charge-transporting material.

When the photosensitive layer is constituted according to the form (3), i.e., when it is a single-layer structure, a coating solution prepared by dispersing or dissolving the charge-generating material previously described and the compound represented by the formula (I) in a suitable binder above mentioned may be applied to a support to form a layer. This layer may preferably have a thickness of from 5 μm to 40 μm, and particularly preferably from 10 μm to 30 μm.

In the present invention, a layer having a barrier function and an adhesive function, i.e., a subbing layer, can also be provided between the conductive support and the photosensitive layer.

Materials for the subbing layer may include polyvinyl alcohol, polyethylene oxide, ethyl cellulose, methyl cellulose, casein, polyamide, glue and gelatin.

These materials may be dissolved in a suitable solvent and the resulting solution may be coated on the conductive support. The subbing layer thus formed may preferably have a coating thickness of not more than 5 μm, and particularly from 0.2 to 3.0 μm.

In the present invention, a resin layer or a resin layer in which a conductive material has been dispersed may also be provided on the photosensitive layer so that the photosensitive layer can be protected from mechanical and electrical external forces.

All the layers described above can be formed on the conductive support by any coating processes such as dip coating, spray coating, spin coating, roller coating, Meyer bar coating and blade coating, using a suitable organic solvent.

The conductive support in the present invention may include, for example, supports of the following forms:

(1) A support comprising a metal such as aluminum, an aluminum alloy, stainless steel or copper, formed into a plate or a drum.

(2) A support comprising a non-conductive support made of glass, resin or paper, or the above conductive support (1), on which a film has been formed by vacuum deposition of a metal such as palladium, rhodium, gold or platinum or by lamination of a film of such a metal.

(3) A support comprising a non-conductive support made of glass, resin or paper, or the above conductive support (1), on which a layer comprised of a conductive compound such as a conductive polymer, tin oxide or indium oxide has been formed by vacuum deposition or coating.

The electrophotographic photosensitive member of the present invention can be applied not only in electrophotographic copying machines, but also facsimile machines, laser printers, CRT printers. It can also be widely used in electrophotographic lithography systems and so forth in which electrophotography is applied.

FIG. 1 schematically illustrates an example of the constitution of a transfer electrophotographic apparatus in which the electrophotographic photosensitive member according to the present invention is used.

As shown in FIG. 1, the numeral 1 denotes a drum photosensitive member serving as an image supporting member, which is rotated around a shaft 1*a* at a given peripheral speed in the direction shown by arrow. In the course of rotation, the photosensitive member I is uniformly charged on its periphery, with positive or negative given potential by the operation of a charging means 2. and then photoimagewise exposed to light L (slit exposure, laser beam scanning exposure, etc.) at an exposure zone 3 by the operation of an imagewise exposure means (not shown). As a result, electrostatic latent images corresponding to the exposure images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P fed from a paper feed section (not shown) to the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is cleaned of excess toner remaining after the transfer, using a cleaning means 6. Thus the photosensitive member is cleaned on its surface, further subjected to charge elimination by a pre-exposure means 7, and then repeatedly used for the formation of images.

The charging means 2 for providing uniform charge on the photosensitive member 1 include corona chargers, which are widely used. As the transfer means 5, corona transfer units are also widely used.

The electrophotographic apparatus may comprise a combination of plural components selected from the constituents such as the above photosensitive member, developing means and cleaning means and joined as one device unit so that the unit can be freely mounted on or detached from the body of the apparatus. For example, at least one of the charging means, developing means and cleaning means is joined with the photosensitive member into one device unit so that the unit can be freely mounted or detached using a guide means such as a rail provided in the body of the apparatus.

When the electrophotographic apparatus is used for a copying machine or a printer, the optical image exposing light L is the light reflected from, or transmitted through an original. Alternatively, L is the scanning laser beam or the light derived by driving an LED array or a liquid crystal shutter array, both according to signals obtained by reading an original with a sensor and converting the information into signals.

Figure 2:
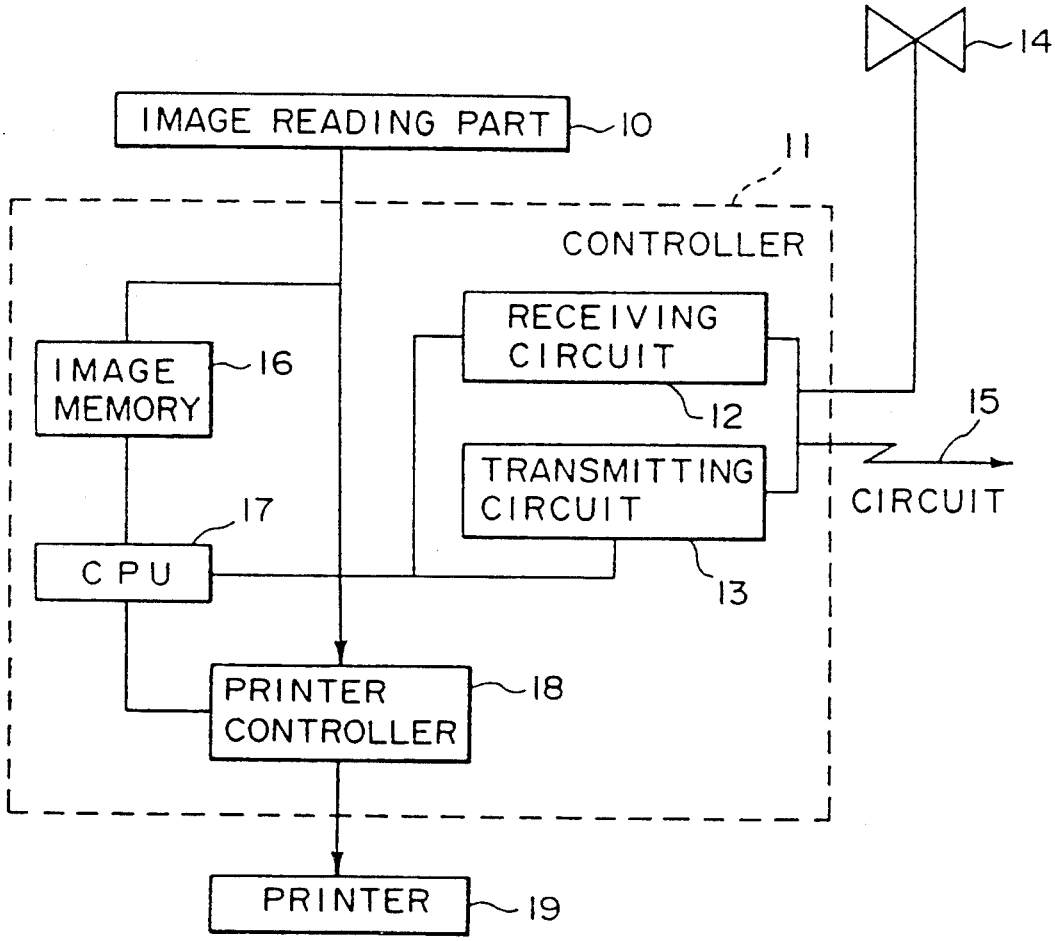
FIG. 2 is a block diagram of a facsimile system in which the electrophotographic photosensitive member of the present invention is used.

When used as a printer of a facsimile machine, the optical image exposing light L serves as exposing light used for the printing of received data. FIG. 2 illustrates an example thereof in the form of a block diagram.

As shown in FIG. 2, a controller 11 controls an image reading part 10 and a printer 19. The whole of the controller 11 is controlled by CPU 17. Image data output from the image reading part is sent to the other facsimile station through a transmitting circuit 13. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the coded image information for one page to the printer controller 18. The printer controller 18, having received the image information for one page from the CPU 17, controls the printer 19 so that the image information for one page is recorded.

The CPU 17 receives image information for next page in the course of the recording by the printer 19.

Images are received and recorded in the above way.

EXAMPLE 1

To 600 ml of an aqueous solution consisting of 5.5 g (138 mmol) of sodium hydroxide and 66 g (200 mmol) of potassium hexacyanoferrate, 200 ml of an ethanol solution containing 4.50 g (33 mmol) of 2,4,6-trimethylphenol and 7.27 g (33 mmol) of 2,6-di-t-butyl-4-methylphenol, were dropwise added in 20 minutes with stirring. After the stirring was continued for five hours, precipitated crystals were collected. The resulting crude crystals were purified by silica gel column chromatography to give 2.1 g of a compound of the exemplary compound (5) (Yield: 18%).

Results of elementary analysis of this compound are shown below.

| | C | H |
|---|---|---|
| Calculated: | 82.24% | 8.63% |
| Found: | 82.19% | 8.69% |

Characteristics of the resulting compound were evaluated in the following manner.

First, 4 g of oxytitanium phthalocyanine obtained according to a preparation example disclosed in Japanese Patent Application Laid-open No. 61-239248 (U.S. Pat. No. 4,728,592) was added to a solution prepared by dissolving 7 g of polyvinyl butyral (degree of butyralation: 68 mol %; weight average molecular weight: 35,000) in 95 ml of cyclohexanone, and these were dispersed together for 20 hours using a sand mill. A coating solution was thus prepared.

This coating solution was diluted and thereafter applied to an aluminum sheet by Meyer bar coating so as to give a dried coating thickness of 0.1 μm. A charge generation layer was thus formed.

Next, 5 g of the compound obtained as above mentioned as a charge-transporting material and 6 g of polycarbonate (weight average molecular weight: 35,000) were dissolved in 100 g of chlorobenzene, and the resulting solution was coated on the charge generation layer by Meyer bar coating, followed by drying to form a charge transport layer with a dried coating thickness of 14 μm. Thus an electrophotographic photosensitive member was obtained.

This electrophotographic photosensitive member was corona-charged by a static system at +6 kV using an electrostatic copy paper test machine (Model EPA-8100, manufactured by Kawaguchi Denki K. K.). The charged member was maintained in dark for 1 second, followed by exposure to light with illuminance of 20 lux to examine their charge characteristics.

Measured as the charge characteristics were the surface potential ($V_0$), the potential ($V_1$) after the dark-decaying for 1 second and the quantity of exposure ($E_{\frac{1}{2}}$) required for reducing the potential ($V_1$) to ½ the original value.

To also evaluate potential stability after repeated use, the electrophotographic photosensitive member produced in the above was mounted on a cylinder for a photosensitive drum of a modified copying machine (NP-6650, manufactured by Canon Inc). After copies were taken on 2,000 sheets using this copying machine, the dark-portion potential ($V_D$) and light-portion potential ($V_L$) were measured. Initial $V_D$ and $V_L$ were set to be +650 V and +150 V, respectively.

Results obtained are shown in Table 1.

EXAMPLES 2 TO 7

Compounds of the exemplary compounds (1), (4), (6), (13) and (15) were obtained in the same manner as in Example 1 except that the 2,4,6-trimethylphenol and 2,6-di-t-butyl-4-methylphenol used in Example 1 were replaced with i) 2,4,6-trimethylphenol alone, ii) 2,6-di-t-butyl-4-methylphenol alone, iii) 2,6-dimethyl-4-methylphenol and 2,6-di-n-butyl-4-methylphenol, iv) 2,4,6-trimethylphenol and 2-benzyl-4,6-dimethylphenol, v) 4,6-dimethyl-2-phenylphenol alone and vi) 4-methyl-2,6-di-n-propylmethylphenol and 4-methyl-2,6-diphenylphenol, respectively.

Electrophotographic photosensitive members were prepared in the same manner as in Example 1 except for use of the respective compounds, and evaluation was made similarly.

Results obtained are shown in Table 1.

TABLE 1

| | Exemplary compound | $V_0$ (+V) | $V_1$ (+V) | $E_{\frac{1}{2}}$ (lux · sec) | Initial stage $V_D$ (+V) | Initial stage $V_L$ (+V) | After 2,000 sheet running $V_D$ (+V) | After 2,000 sheet running $V_L$ (+V) |
|---|---|---|---|---|---|---|---|---|
| Example: | | | | | | | | |
| 1 | (5) | 690 | 685 | 2.8 | 650 | 150 | 649 | 148 |
| 2 | (1) | 698 | 690 | 2.9 | 650 | 150 | 641 | 141 |
| 3 | (4) | 700 | 695 | 3.0 | 650 | 150 | 645 | 149 |
| 4 | (6) | 701 | 697 | 2.0 | 650 | 150 | 650 | 148 |
| 5 | (10) | 697 | 694 | 2.5 | 650 | 150 | 642 | 147 |
| 6 | (13) | 694 | 690 | 2.4 | 650 | 150 | 647 | 148 |
| 7 | (15) | 690 | 685 | 2.0 | 650 | 150 | 640 | 145 |

COMPARATIVE EXAMPLES 1 TO 4

Electrophotographic photosensitive members were prepared in the same manner as in Example 1 except for use of the following comparative compounds as charge-transporting materials. Evaluation was also made similarly.

Comparative Compound (1)

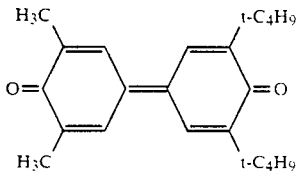

(disclosed in The Proceedings of the 58th Spring Annual Meeting of Japan Chemical Society, 31H38)

Comparative Compound (2)

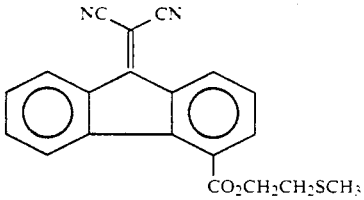

(disclosed in Japanese Patent Application Laid-open No. 61-148159)

Comparative Compound (3)

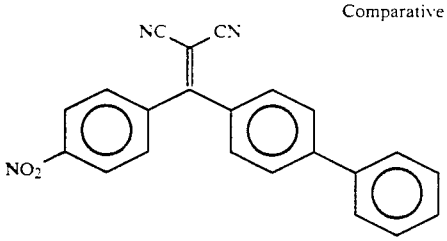

(disclosed in Japanese Patent Application Laid-open No. 63-175860)

Comparative Compound (4)

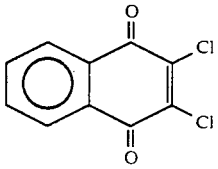

(disclosed in Japanese Patent Application

-continued

Laid-open No. 63-85749)

Results obtained are shown in Table 2.

TABLE 2

| | Comparative compound | $V_0$ (+V) | $V_1$ (+V) | $E_{\frac{1}{2}}$ (lux · sec) | Initial stage $V_D$ (+V) | Initial stage $V_L$ (+V) | After 2,000 sheet running $V_D$ (+V) | After 2,000 sheet running $V_L$ (+V) |
|---|---|---|---|---|---|---|---|---|
| Comparative Example | | | | | | | | |
| 1 | (1) | 690 | 671 | 5.9 | 650 | 150 | 601 | 207 |
| 2 | (2) | 691 | 680 | 84.0 | —* | —* | —* | —* |
| 3 | (3) | 692 | 687 | 7.5 | —* | —* | —* | —* |
| 4 | (4) | 711 | 704 | 14.5 | —* | —* | —* | —* |

*Comparative Examples 2 to 4 showed such poor sensitivities and such high residual potentials that it was impossible to set potentials.

EXAMPLE 8

A compound of the exemplary compound (3) was obtained in the same manner as in Example except that the 2,4,6-trimethylphenol nd 2,6-di-t-butyl-4-methylphenol were replaced with 2,4,6-triethylphenol.

Characteristics of the resulting compound were evaluated in the following manner.

On an aluminum substrate, a solution prepared by dissolving 5 g of N-methoxymethylated nylon 6 resin (weight average molecular weight: 32,000) and 5 g of alcohol soluble copolymer nylon (weight average molecular weight: 29,000) in 95 g of methanol was applied by Meyer coating to form a subbing layer with a dried coating thickness of 1 μm.

Next, 1 g of a charge-generating material of the following structural formula:

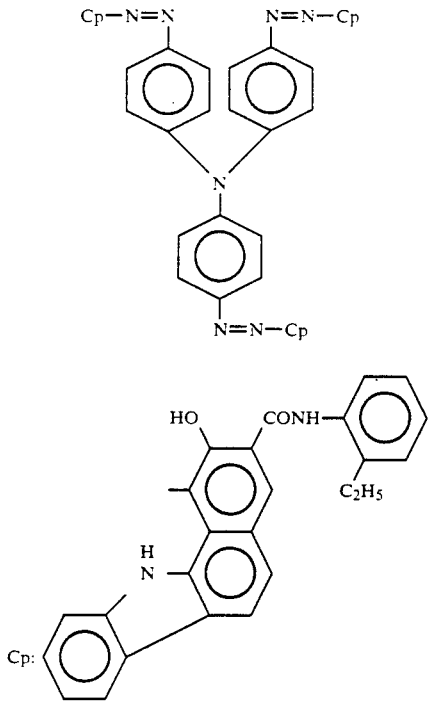

0.6 g of polyvinyl butyral (degree of butyralation: 70%; weight average molecular weight: 50,000) and 60 g of dioxane were dispersed for 20 hours using a ball mill.

The resulting dispersion was applied by blade coating on the subbing layer already formed, to form a charge generation layer with a dried coating thickness of 0.1 μm.

Next, 10 g of a compound of the exemplary compound (3) previously obtained and 10 g of polymethyl methacrylate (weight average molecular weight: 50,000) were dissolved in 110 g of chlorobenzene, and the resulting solution was applied by blade coating on the charge generation layer already formed, to form a charge transport layer with a dried coating thickness of 13 μm.

An electrophotographic photosensitive member thus produced was corona-charged at +6 kV. The surface potential ($V_0$) at this time was measured. The surface potential ($V_1$) after this photosensitive member was left in the dark for 1 second was also measured. The sensitivity was evaluated based on the measurement of the quantity of exposure ($E_{\frac{1}{2}}$: μJ/cm$^2$) required for reducing the potential $V_1$ after the dark-decaying to one-half. Here, a gallium-aluminum-arsenic three-component semiconductor laser (output: 5 mW; oscillation wavelength: 780 nm) was used as a light source.

Results obtained are shown below:

$V_O$:+682 V
$V_1$:+671 V
$E_{\frac{1}{2}}$:2.1 μJ/cm$^2$

Next, the above photosensitive member was fitted to a modified machine of a transfer development type digital copier NP-9330, manufactured by Canon Inc., equipped with the same semiconductor laser as the above, to carry out an actual image forming test.

The test was carried out under the surface potential after primary charging and the surface potential after exposure set to +600 V and +100V, respectively (quantity of exposure: 2.0 μJ/cm2). Both characters and pictures were printed in a good state.

Images were further continuously produced on 3,000 sheets. As a result, stable prints were obtained from the initial stage to 3,000th sheet printing.

EXAMPLE 9

First, 7 g of oxytitanium phthalocyanine obtained according to a preparation example disclosed in Japanese Patent Application Laid-open No. 62-67094 (U.S. Pat. No. 4,664,997) was added to a solution prepared by dissolving 4 g of polyvinyl benzal (degree of benzalation: 78 mol %; weight average molecular weight: 100,000) in 100 g of cyclohexanone, and was dispersed for 48 hours using a ball mill. The resulting dispersion was applied on an aluminum sheet by Meyer bar coating, followed by drying at 90° C. for 30 minutes to form a charge generation layer with a thickness of 0.15 μm.

Next, a solution prepared by dissolving 5 g of a compound of the exemplary compound (5) obtained in the same manner as in Example 1 and 5 g of a bisphenol Z polycarbonate resin (weight average molecular weight: 50,000) in 70 g of a mixed solvent of chlorobenzene/N,N-dimethylformamide (1 part by weight/1 part by weight) was applied by Meyer bar coating on the charge generation layer already formed, followed by drying at 130° C. for 2 hours to form a charge transport layer with a thickness of 18 μm.

Charge characteristics of the electrophotographic photosensitive member thus prepared was evaluated in the same manner as in Example 8 to obtain the following results:

$V_0$:+690 V
$V_1$:+685 V
$E_{\frac{1}{2}}$:2.0 μJ/cm$^2$

EXAMPLE 10

A compound of the exemplary compound (8) was obtained in the same manner as in Example 1 except that the 2,4,6-trimethylphenol and 2,6-di-t-butyl-4-methylphenol were replaced with 2-ethyl-4,6-dimethylphenol.

Characteristics of the resulting compound were evaluated in the following manner.

Two grams of a dye represented by the following structural formula:

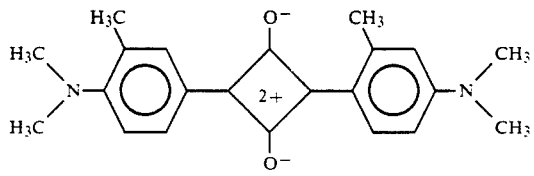

and 4 g of the compound of the exemplary compound (8) were mixed in 40 g of a toluene (70 parts by weight)/N,N-dimethylformamide (30 parts by weight) solution of polycarbonate (weight average molecular weight: 30,000), and then dispersed for 10 hours using a ball mill. The resulting dispersion was diluted and thereafter applied on an aluminum sheet by Meyer bar coating, followed by drying at 100° C. for 1.6 hours to form a photosensitive layer with a thickness of 14 μm.

Electrophotographic performance of the electrophotographic photosensitive member thus prepared was evaluated in the same manner as in Example 1. Results obtained are shown below:

$V_0$:+685 V
$V_1$:+685 V
$E_{\frac{1}{2}}$:3.6 lux.sec

Initial potential:

$V_D$:+650 V
$V_L$:+150 V

Potential after 10,000 sheet running:

$V_D$:+639 V
$V_L$:+161 V

EXAMPLE 11

A compound of the exemplary compound (11) was obtained in the same manner as in Example 1 except that the 2,4,6-trimethylphenol and 2,6-di-t-butyl-4-methylphenol were replaced with 4-methyl-2,6-t-n-propylphenol and 2,6-di-t-butyl-4-methylphenol.

Characteristics of the resulting compound were evaluated in the following manner.

On an aluminum substrate, a methanol solution of 5% of alcohol-soluble copolymer nylon (weight average molecular weight: 80,000) was applied to form a subbing layer with a dried coating thickness of 1 μm.

Next, as a charge-generating material, 5 g of a trisazo pigment of the following structural formula:

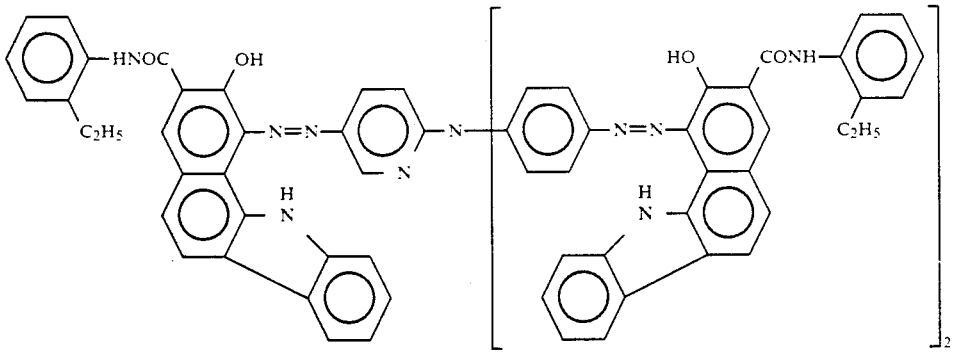

was dispersed in 50 ml of tetrahydrofuran, using a sand mill.

Subsequently, 5 g of the compound of the exemplary compound (11) and 10 g of polycarbonate (weight average molecular weight: 35,000) were dissolved in a mixed solvent of chlorobenzene (70 parts by weight) and dichloromethane (30 parts by weight), and the resulting solution was added to the dispersion previously prepared, followed by further dispersion for 10 hours using a sand mill.

The resulting dispersion was applied by Meyer bar coating on the subbing layer already formed, so as to give a dried coating thickness of 16 μm.

Charge characteristics of the electrophotographic photosensitive member thus prepared was measured in the same manner as in Example 1 to obtain the following results:

$V_0$:+685 V
$V_1$:+680 V
$E_{\frac{1}{2}}$:4.0 lux.sec

EXAMPLE 12

In 70 g of chlorobenzene, 5 g of a compound of the exemplary compound (6) obtained in the same manner as in Example 4 as a charge-transporting material and 5 g of polycarbonate (weight average molecular weight: 35,000) were dissolved to give a solution. This solution was applied on an aluminum sheet by Meyer bar coating to form a charge transport layer with a dried coating thickness of 14 μm.

Next, 2 g of disazo pigment represented by the following structural formula:

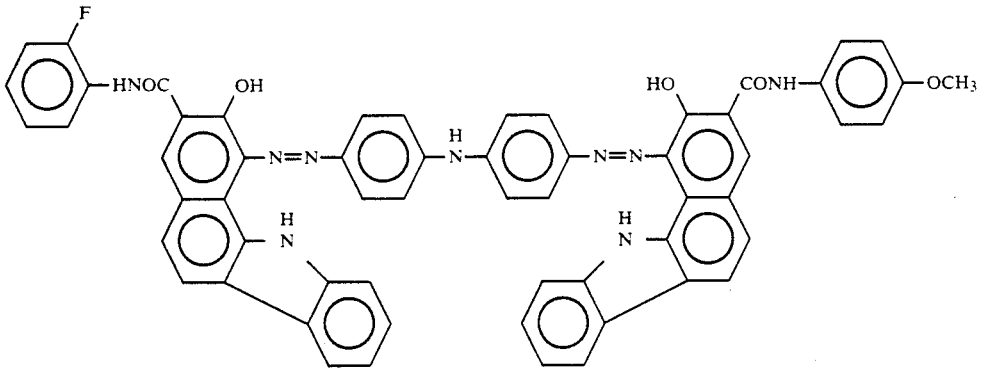

was added to a solution prepared by dissolving 1 g of polyvinyl butyral (degree of butyralation: 80 mol %) 1 g dissolved in 45 ml of cyclohexanone, and these were dispersed together for 24 hours using a sand mill. A coating dispersion was thus prepared.

This coating dispersion was diluted and thereafter applied to the above charge transport layer by Meyer bar coating so as to give a dried coating thickness of 0.3 μm. A charge generation layer was thus formed. Using this charge generation layer, an electrophotographic photosensitive member was obtained.

Charge characteristics of this electrophotographic photosensitive member were evaluated in the same manner as in Example 1 except that the corona-charging was carried out at −5 kV.

Results obtained are shown below.

$V_0$:−680 V
$V_1$:−665 V
$E_{\frac{1}{2}}$:3.5 lux.sec

We claim:

1. An electrophotographic photosensitive member comprising a conductive support and a photosensitive layer provided on said conductive support; said photosensitive layer containing a compound having electron transporting properties represented by the following formula (I).

Formula (I)

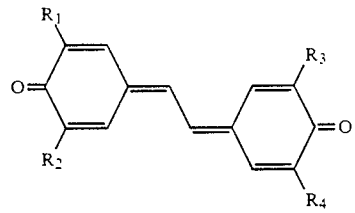

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different.

2. An electrophotographic photosensitive member according to claim 1, wherein said photosensitive layer comprises a charge generation layer and a charge transport layer.

3. An electrophotographic photosensitive member according to claim 2, wherein said charge transport layer is laminated on said charge generation layer.

4. An electrophotographic photosensitive member according to claim 2, wherein said charge generation layer is laminated on said charge transport layer.

5. An electrophotographic photosensitive member according to claim 1, wherein said photosensitive layer has a single-layer structure.

6. An electrophotographic photosensitive member according to claim 1, wherein a subbing layer is provided between said conductive support and said photosensitive layer.

7. An electrophotographic photosensitive member according to claim 1, wherein a protective layer is provided on said photosensitive layer.

8. An electrophotographic apparatus comprising an electrophotographic photosensitive member, an electrostatic latent image forming means, a means for developing the electrostatic latent image formed, and a means for transferring the developed image to a transfer medium;

said electrophotographic photosensitive member comprising a conductive support and a photosensitive layer provided on said conductive support; said photosensitive layer containing a compound having electron transporting properties represented by the following formula (I).

Formula (I)

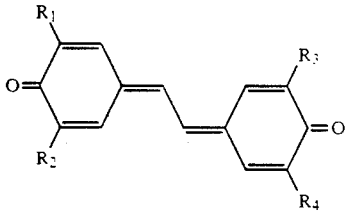

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different.

9. A device unit comprising an electrophotographic photosensitive member, a CHARGING means, DEVELOPING and a cleaning means;

said electrophotographic photosensitive member comprising a conductive support and a photosensitive layer provided on said conductive support; said photosensitive layer containing a compound having electron transporting properties represented following formula (I).

Formula (I)

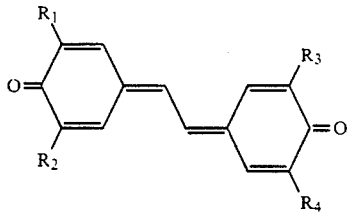

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different; and said device unit holding said electrophotographic photosensitive member, developing means and cleaning means as one unit, and said device unit being detachably provided in the body of an electrophotographic apparatus.

10. A facsimile machine comprising an electrophotographic apparatus and a receiver means for receiving image information from a remote terminal;

said electrophotographic apparatus comprising an electrophotographic photosensitive member; and said electrophotographic photosensitive member comprising a conductive support and a photosensitive layer provided on said conductive support; said photosensitive layer containing a compound having electron transporting properties represented by the following formula (I).

Formula (I)

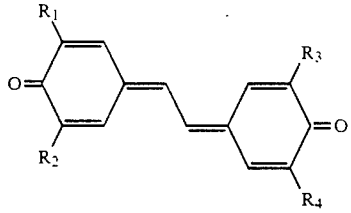

wherein $R_1$, $R_2$, $R_3$ and $R_4$ each represents a hydrogen atom, an alkyl group, an aralkyl group or an aryl group, and $R_1$, $R_2$, $R_3$ and $R_4$ may be the same or different.

* * * * *

UNITED STATES PATENT AND TRADEMARK OFFICE

CERTIFICATE OF CORRECTION

PATENT NO. : 5,176,976

DATED : January 5, 1993

INVENTOR(S) : TOSHIHIRO KIKUCHI, ET AL.

It is certified that error appears in the above-identified patent and that said Letters Patent is hereby corrected as shown below:

COLUMN 1

Line 7, "Invent" should read --Invention--.
Line 23, "an" should read --and--.
Line 40, "publication" should read --Publication--.
Line 61, "bad" should be deleted, (second occurrence).

COLUMN 2

Line 40, "Organic" should read --organic--.
Line 46, "and," should read --and--.

COLUMN 3

Line 18, "different one" should read --different.--.
Line 19, "another." should be deleted.

COLUMN 4

Line 25, Under Exemplary Compound (7),
"$R_1$, $R_2$: H" should read --$R_1$, $R_2$:-H--.

COLUMN 5

Line 61, "oases" should read --cases--.
Line 68, "the" should read --of the--.

COLUMN 10

Line 16, "in" should read --in the--.
Line 18, "their" should read --the--.
Line 20, "the" (second occurrence) should be deleted.

UNITED STATES PATENT AND TRADEMARK OFFICE

CERTIFICATE OF CORRECTION

PATENT NO. : 5,176,976

DATED : January 5, 1993

INVENTOR(S) : TOSHIHIRO KIKUCHI, ET AL.

It is certified that error appears in the above-identified patent and that said Letters Patent is hereby corrected as shown below:

COLUMN 12

Line 23, "nd" should read --and--.
Line 30, "alcohol soluble" should read --alcohol-soluble--.

COLUMN 14

Line 36, "1.6 hours" should read --1.5 hours--.

COLUMN 17

Line 49, "CHARGING" should read --charging-- and "DE-" should read --a developing--.
Line 50, "VELOPING" should be deleted.

COLUMN 18

Line 21, "member, developing" should read --member, charging means, developing--.

Signed and Sealed this

Thirtieth Day of November, 1993

Bruce Lehman

*Attest:*

BRUCE LEHMAN

*Attesting Officer*

*Commissioner of Patents and Trademarks*

--